United States Patent [19]

Rothmayer

[11] 4,098,010

[45] Jul. 4, 1978

[54] SKI-BOOT

[76] Inventor: Karl-Heinz Rothmayer, Sintzenichstrasse 12, D-8000 Munich 71, Fed. Rep. of Germany

[21] Appl. No.: 698,872

[22] Filed: Jun. 23, 1976

[30] Foreign Application Priority Data

| | | | |
|---|---|---|---|
| Jun. 30, 1975 | [DE] | Fed. Rep. of Germany | 2529081 |
| Sep. 3, 9175 | [DE] | Fed. Rep. of Germany | 2539068 |
| Apr. 29, 1976 | [DE] | Fed. Rep. of Germany | 2618790 |
| Apr. 29, 1976 | [DE] | Fed. Rep. of Germany | 2518789 |
| May 13, 1976 | [DE] | Fed. Rep. of Germany | 2621267 |

[51] Int. Cl.[2] ..... A43B 5/04

[52] U.S. Cl. ..... 36/117

[58] Field of Search ..... 36/117, 120, 121, 1

[56] References Cited

U.S. PATENT DOCUMENTS

| | | | |
|---|---|---|---|
| 2,810,213 | 10/1957 | Jonas | 36/1 |
| 3,822,491 | 7/1974 | Rathmell | 36/120 |
| 3,955,825 | 5/1976 | Kvbelka et al. | 36/117 |
| 3,957,280 | 5/1976 | Turnheim et al. | 36/117 |
| 3,971,144 | 7/1976 | Brugger-Stuker | 36/117 |

*Primary Examiner*—Patrick D. Lawson

[57] ABSTRACT

The invention relates to a ski-boot and to a ski-binding to be used in combination therewith. The ski-boot is provided with a rolling sole curved continuously in the longitudinal direction, by means of which walking is greatly facilitated, even in the case of a boot having a rigid upper and sole. The binding comprises moulded parts adapted to the curved rolling sole of the ski-boot, upon which the said ski-boot rests when the ski is in use, and which fill up, at least locally, the free space between the flat surface of the ski and the curved rolling sole; or it may have engaging parts which engage positively in recesses or grooves in the sole of the ski-boot, thus securing the ski-boot immovably to the ski. The moulded parts, which may fill up the free space between the surface of the ski and the curved rolling sole, may be either integral functioning parts of the ski-binding or accessories fitted to bindings of conventional design.

7 Claims, 17 Drawing Figures

SKI-BOOT

The invention relates to a ski-boot, to a ski-binding adapted to the said ski-boot, and to a ski-boot/ski-binding combination.

In the case of existing ski-boots, particular care has been taken to ensure that the tread side of the sole shall be as smooth and level as possible, so that it will rest accurately upon the upper surface of the ski. This is intended to provide a good connection with the ski, making it possible for the skier to transfer even the smallest control movements from the foot, through the boot, to the ski. To this end, the upper and sole of the boot are made relatively hard, of a hard synthetic material, for instance, so that the said control movements are not eliminated by deformation before they reach the ski.

One major disadvantage of a ski-boot of this design is that the hard, flat sole makes it very difficult to walk. It is impossible to travel long distances on foot without becoming fatiqued and feeling pain in the calves and shin bones.

It is therefore the purpose of the invention to propose a ski-boot in which it is comfortable to walk in spite of the hard and rigid design of the upper and sole of the boot, but which does no impair the connection to the ski.

This purpose is achieved in that the sole of the ski-boot is in the form of a rolling sole, the tread side thereof being curved continuously in the longitudinal direction.

It has been found that a rolling sole of this kind makes it possible to walk without difficulty, even in a stiff ski-boot. The tread side of the sole is preferably curved continuously with a constant radius of curvature. This provides a smooth rolling motion and makes walking comfortable, which has hitherto been impossible with known ski-boots.

It is obvious that a curve outer sole is in contact with only a small area on the surface of the ski, and that a ski-boot equipped with a rolling sole cannot be properly secured to the ski unless the ski-binding is adapted appropriately thereto. The invention is therefore also concerned with ski-bindings which are adapted to a rolling-sole ski-boot in a manner such that, in spite of the curved outer sole, the boot can be securely held to the ski. The invention proposes a series of solutions to this end.

According to one solution, the tread side of the sole is in the form of a tread part detachably secured to the sole core, the said detachable tread part being preferably secured to the said core by means of a safety binding incorporated into the said core and/or the said tread part. At least one longitudinal or transverse groove, open at each end, is then provided on the two outer sides of the tread part or in the toe and heel, by means of which the said tread part can be slid onto a profiled plate, having a complementary cross section, on the ski. This profiled plate forms a groove, a dovetailed cross-section for example, the sides of which engage with the outer sides, or the toe and heel, of the tread part. The boot is thus held securely to the ski. The safety binding, which connects the tread part to the core part of the sole, effects the release of the ski which becomes necessary in the event of a dangerous fall.

According to another solution, ski-binding parts, co-operating with the toe and heel of the boot, are provided, the said parts being equipped with areas matching the local curvature of the tread side of the sole upon which the boot rests when the ski is in use. Thus the binding parts associated with the toe or the heel of the ski-boot comprise integrally moulded parts which lie under the ski-boot when the ski is in use and support the said boot, in order to provide a fixed contact between the tread and the ski. This solution applies to a plurality of types of ski-binding, e.g. step-in bindings, in which at least one part of the binding, for example the heel retainer, is moved into the locked position by depressing an actuating plate or the like. The basic concept, however, is applicable to so-called rotary plate bindings, in which the heel retaining part, together with a rotary plate, is adapted to rotate about an axis at right angles to the surface of the ski, and to so-called plate bindings, in which the boot is secured to a base plate which is, in turn, coupled to the ski by means of a safety binding which releases the ski in the event of a fall.

In the case of the step-in binding in which the heel retainer is actuated for stepping-in, the solution provides for the actuating plate, actuating spur, or the like to be designed as a moulded part, the height of which increases towards the rear. In the case of the rotary plate binding, the rotary plate is in the form of a moulded part increasing in height towards the rear. In the case of the plate binding, the ends of the base plate are adapted, by increasing the thickness thereof locally, to the rolling sole of the ski-boot, the local increases in thickness being preferably achieved with the aid of moulded parts adjustable in the longitudinal direction of the said base plate.

It is a basic concept of the present invention that existing ski-bindings are modified so that they may be used in conjunction with the rolling sole ski-boot, since there is, of course, a great need to make use of the advantages of the rolling sole ski-boot with those ski-bindings which are now in predominant use, but are designed for ski-boots with conventional flat outer soles. Here again, there are many solutions, depending upon the type of ski-binding.

In the case of the step-in binding, in which at least one part, usually the heel-retaining part, can be moved into the locked position by depressing an actuating plate or the like, this binding part is associated with a moulded part matching the curvature of the outer sole, the said moulded part comprising an element which is pivoted, by the actuating plate or the like, about an axis parallel with the surface of the ski. The said pivoting element is secured to the said moulded part in a manner such that, and is of a size such that, it can be pivoted from above into the path of the actuating plate or the like, so that the latter is pressed down into the locking position whenever the skier steps onto the said moulded part with the rolling sole of the ski-boot.

In the case of a rotary plate binding, the heel retainer part of which is adapted to rotate, in conjunction with a rotary plate, about an axis at right angles to the surface of the ski, the moulded part associated with this heel retainer rests upon the said rotary plate and may be rotated, as a unit with the rotary plate, about a bearing pin secured to the ski.

Some examples of embodiment of the invention are explained hereinafter in greater detail in conjunction with the drawings attached hereto, wherein.

Figure 7:
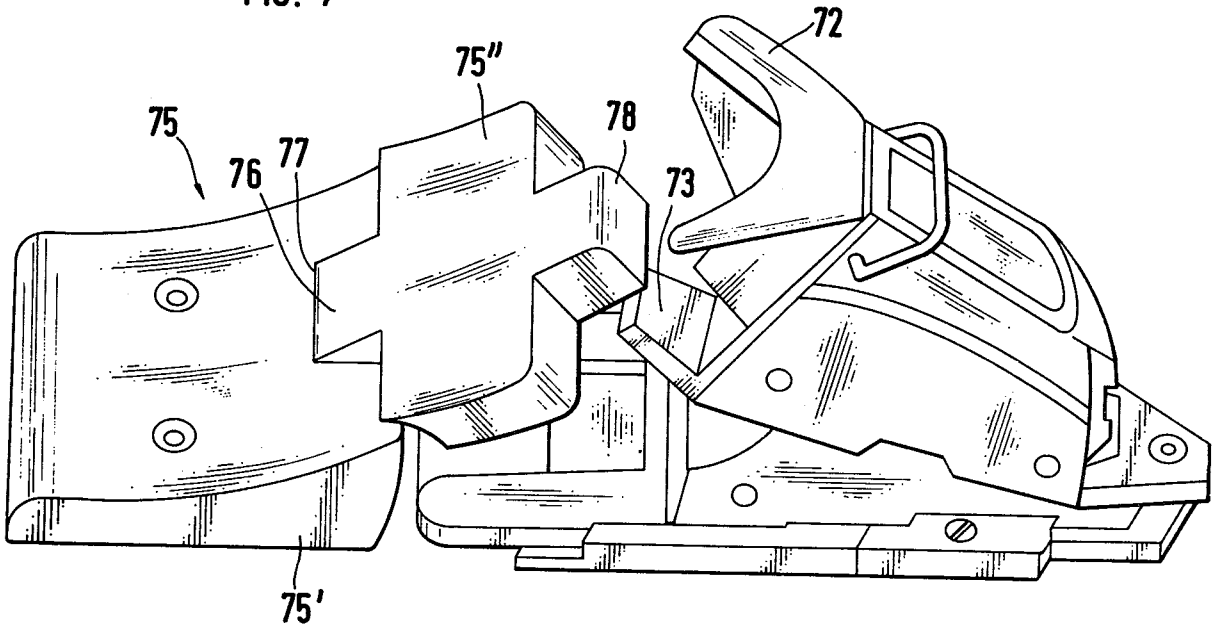
FIG. 7 is a perspective view of the heel retainer part of a so-called step-in binding of known design, with which is associated a moulded part, with a pivoting element, to compensate for the longitudinal curvature of the rolling sole.
Figure 8:
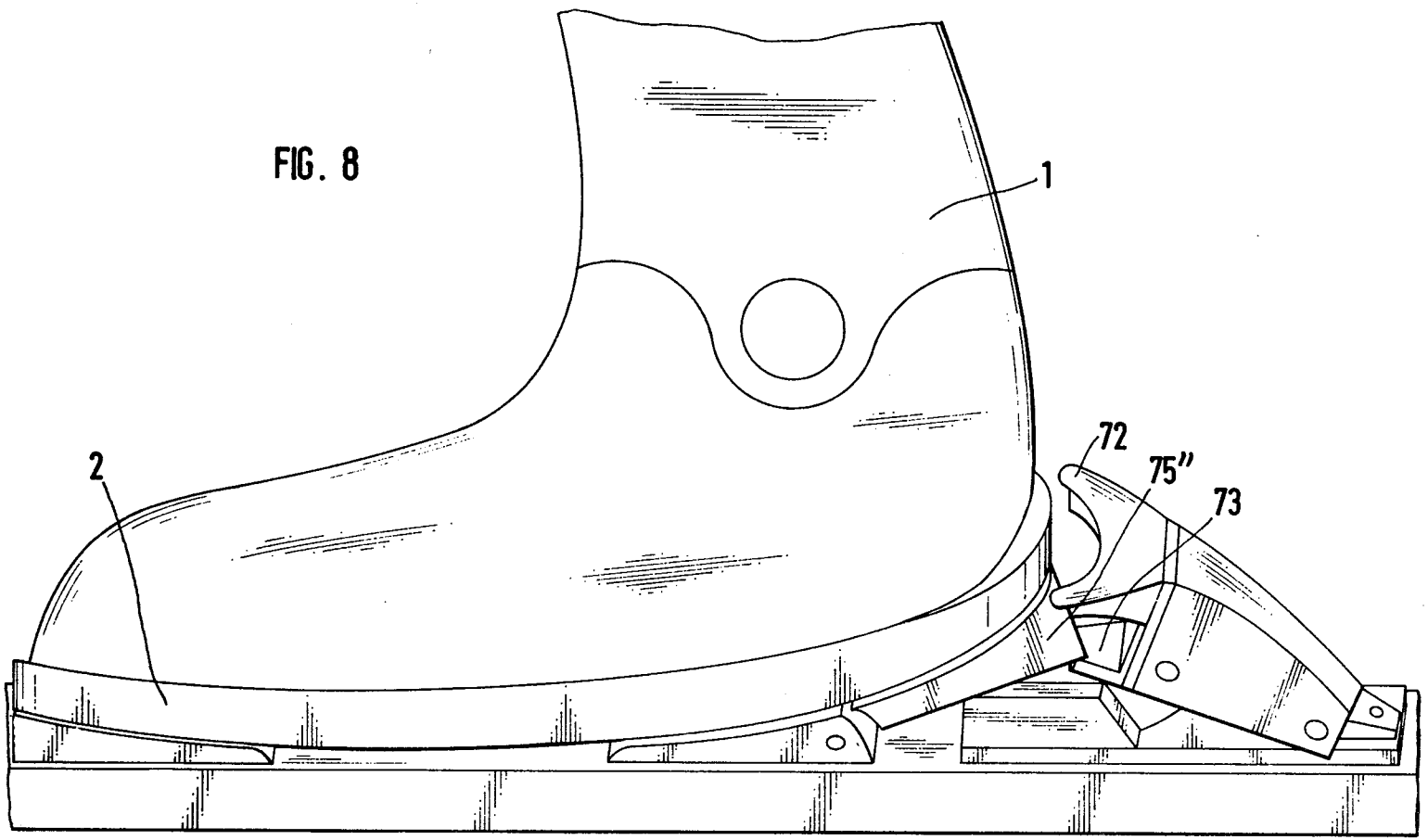
FIG. 8 is a perspective view of a ski-boot/ski-binding combination using a heel retaining part according to FIG. 7, showing the actuation of the said heel retaining part by means of the pivoting element.
Figure 9:
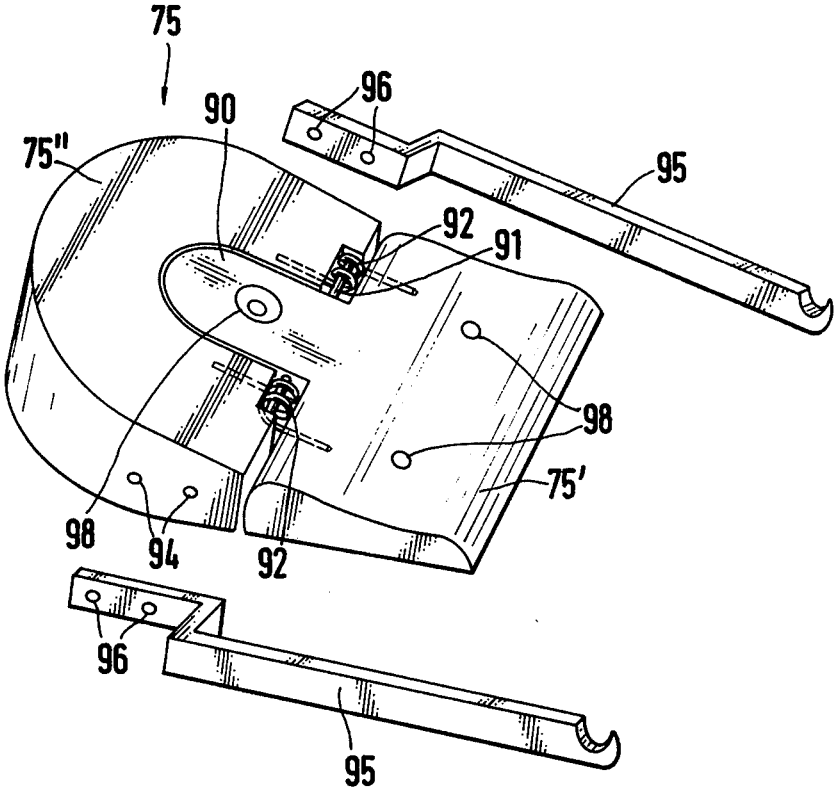
FIG. 9 is a perspective view of a modified moulded part for use in conjunction with a step-in binding according to FIGS. 7 and 8, and which is in the form of a so-called ski-stopper
Figures 11A, 11B:
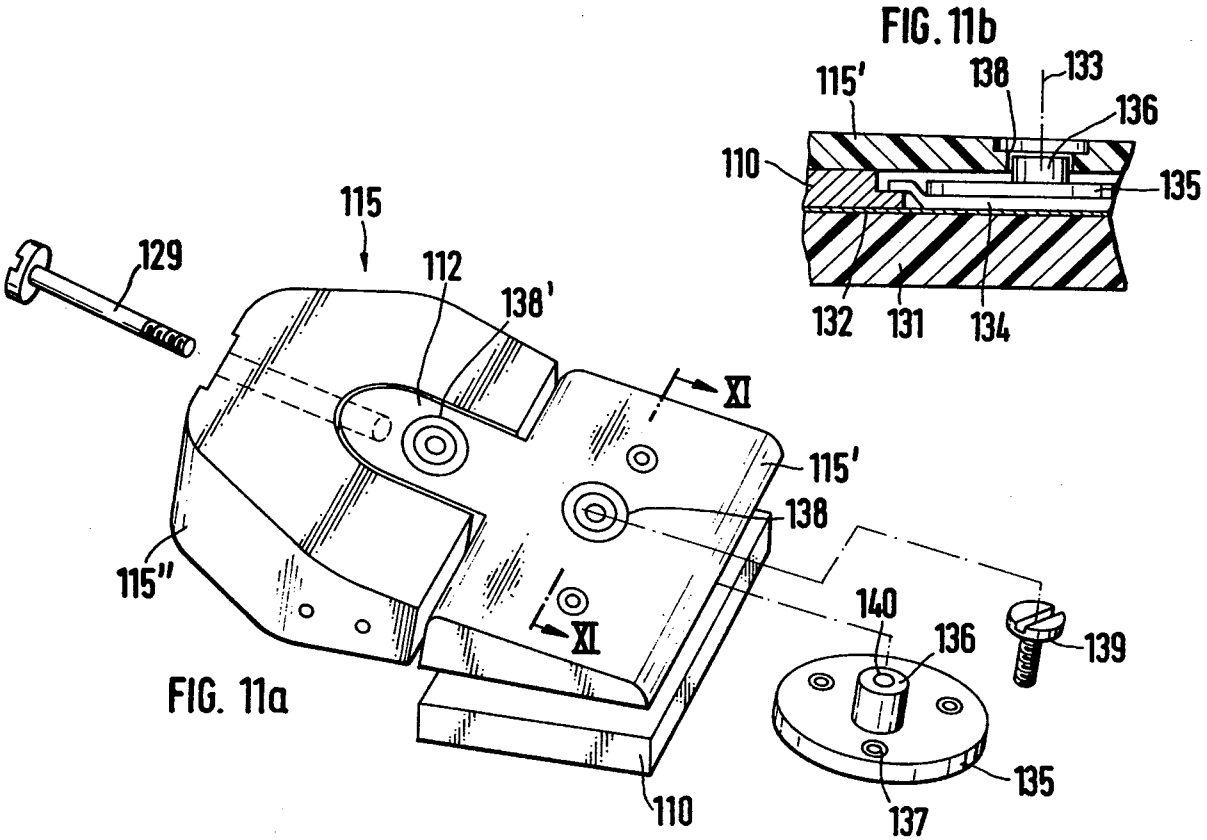
Figure 12B:
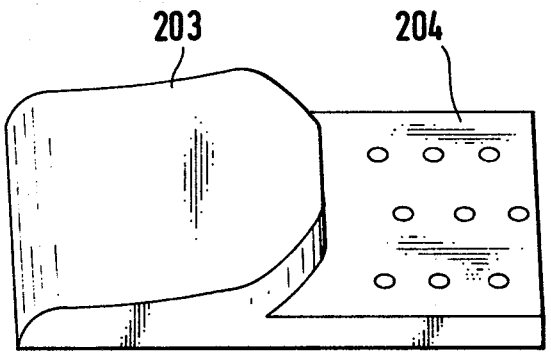
Figure 12A:
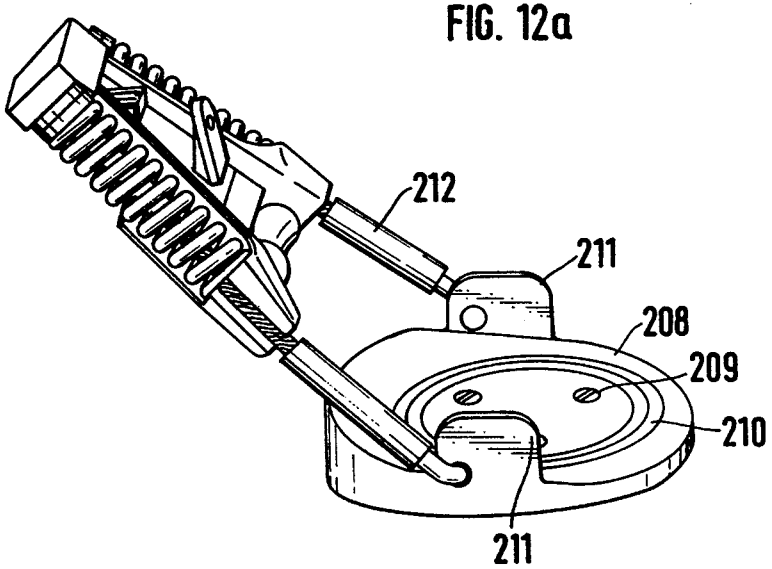
Figure 13:
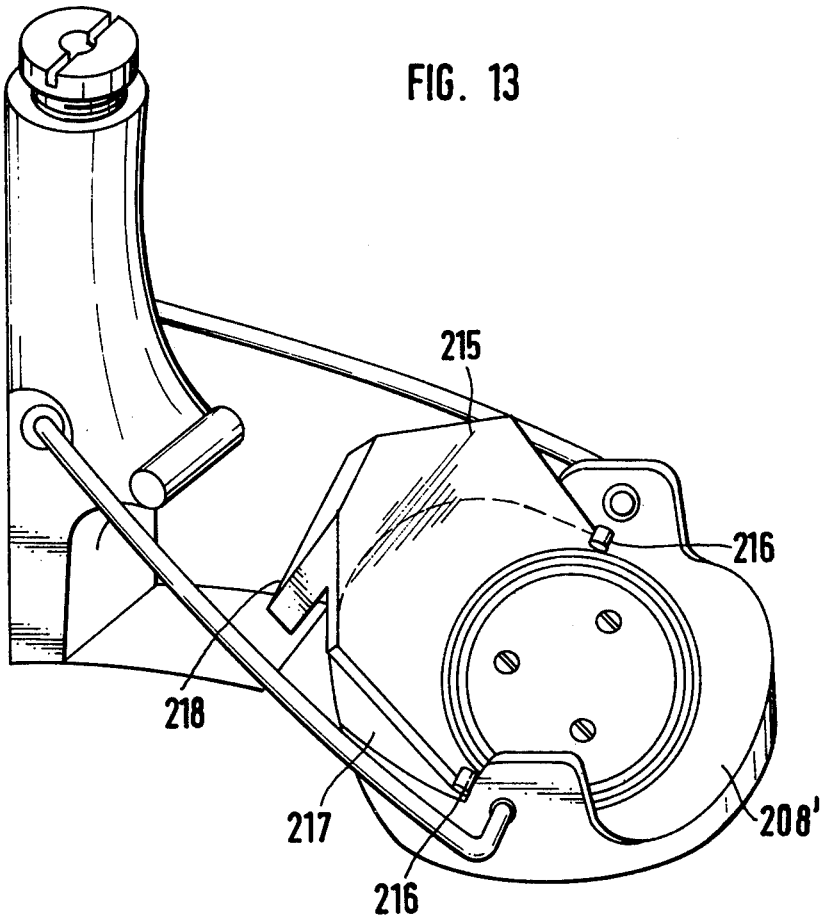
Figure 14:
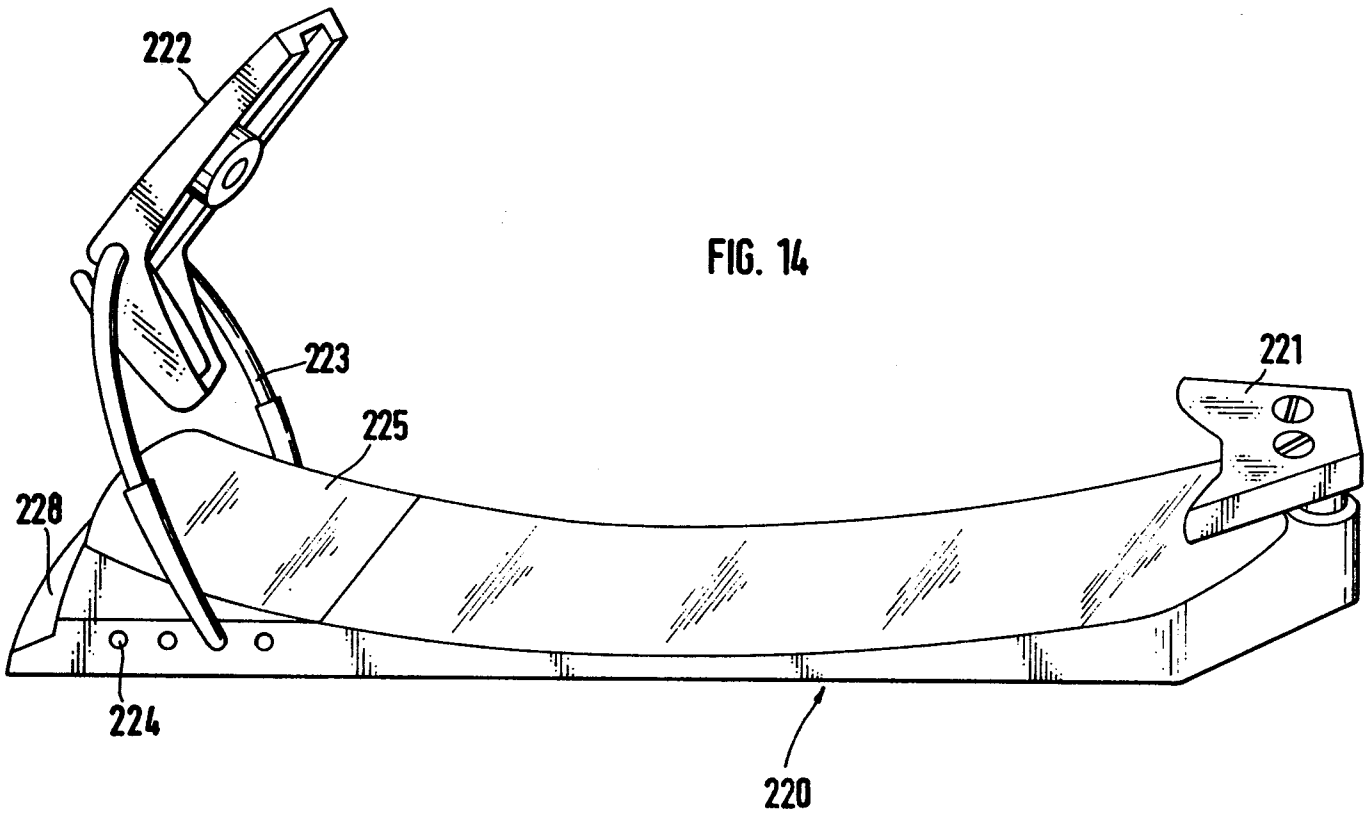

FIG. 11*a* is a perspective view of a moulded part suitable for use in conjunction with a known rotary plate binding, to compensate for the longitudinal curvature of the rolling sole;

FIG. 11*b* is a section along the line XI—XI in FIG. 11*a*;

FIGS. 12*a*, 12*b* are perspective views of a so-called rotary plate binding, in which the rotary plate itself is in the form of a moulded part;

FIG. 13 is a perspective view of a so-called step-in rotary plate binding, in which the rotary plate is in the form of a moulded part and is equipped with a pivoting element similar to the ski-binding according to FIGS. 7 to 9;

FIG. 14 is a perspective view of the base plate of a so-called plate binding.

Figure 1:
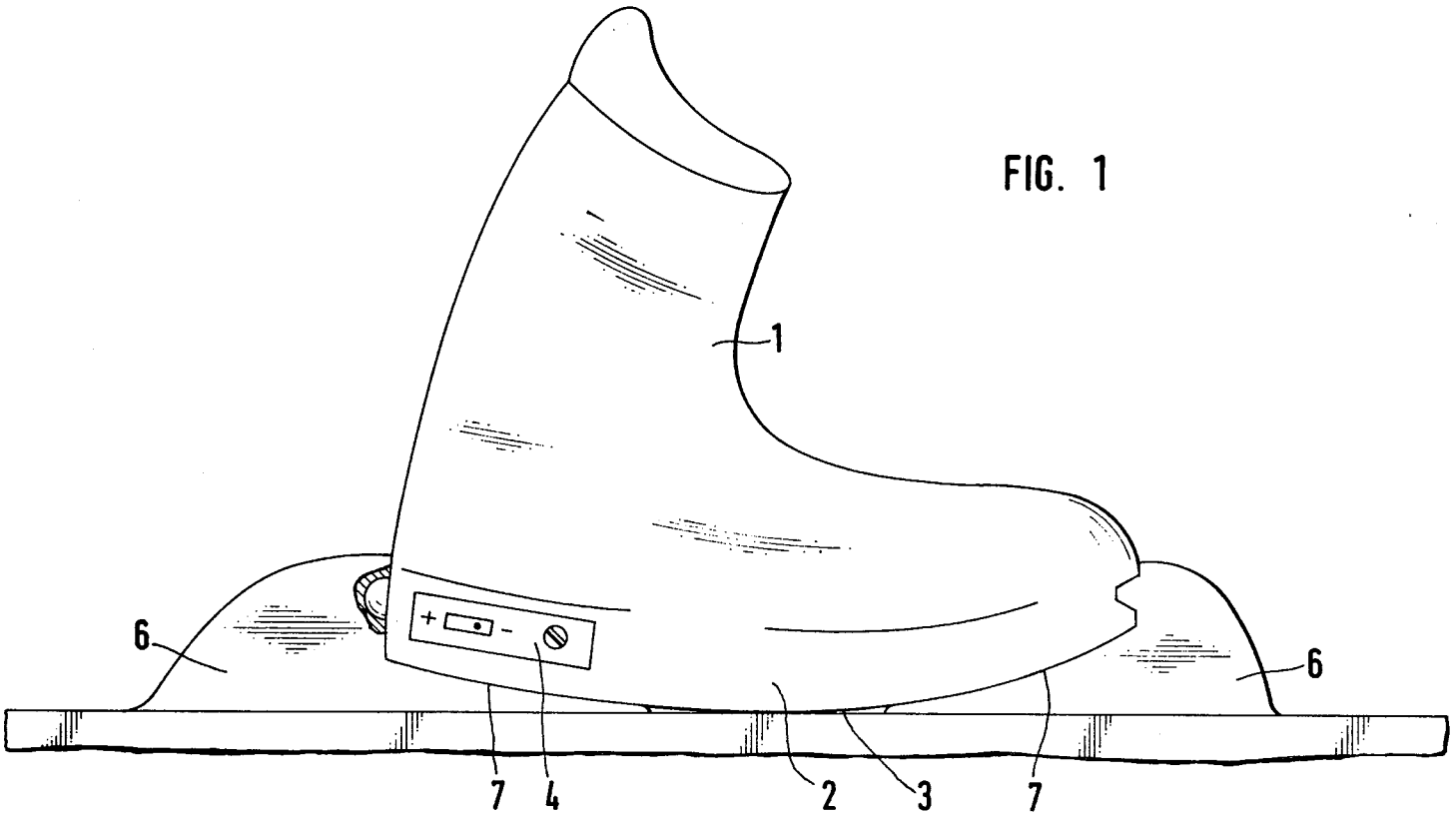
FIG. 1 is a diagrammatic side elevation of a ski-boot/-ski-binding combination, in which the ski-boot is equipped with a rolling sole according to the invention, and in which the parts of the binding associated with the toe and heel of the ski-boot comprise integral moulded parts to compensate for the longitudinal curvature of the said rolling sole.
Figure 2:
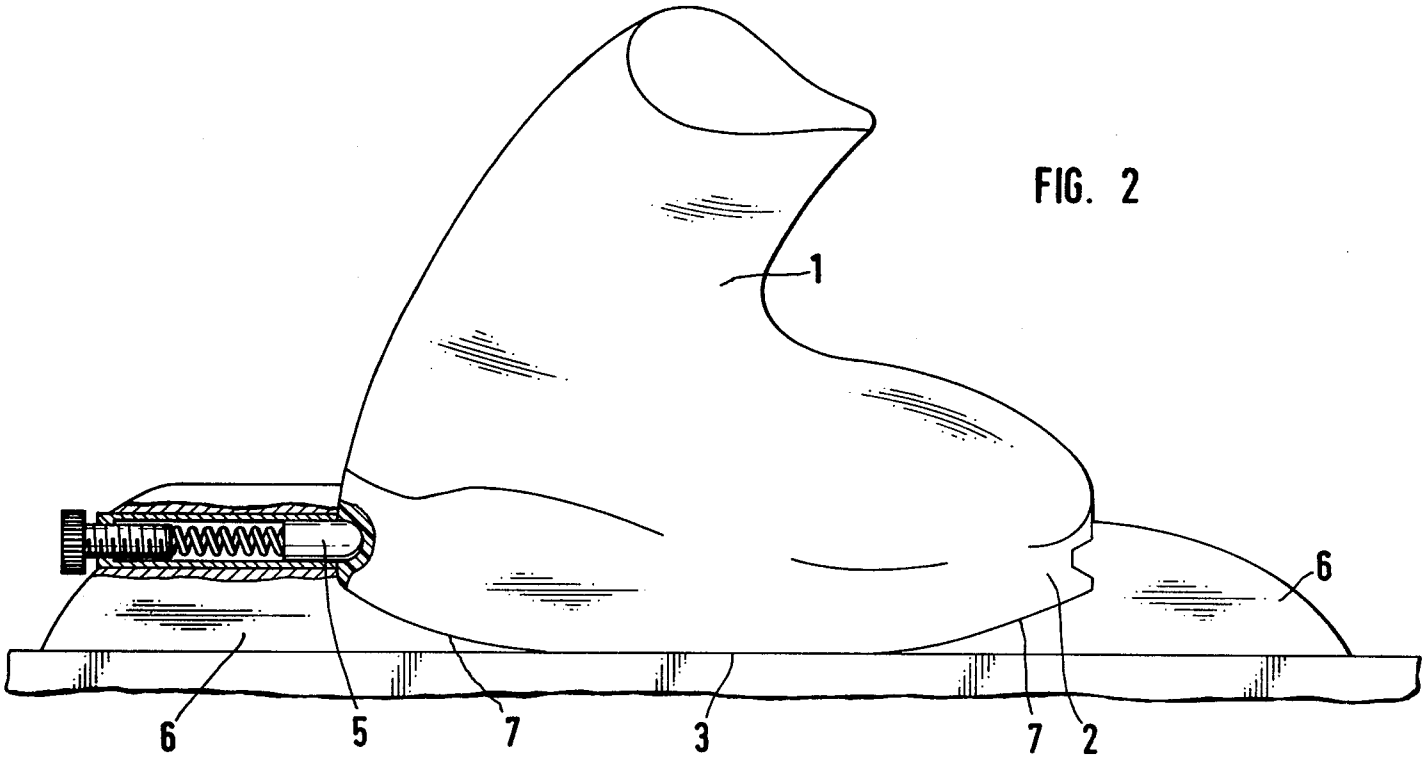
FIG. 2 is an illustration similar to that in FIG. 1, showing a modified form of ski-binding.
Figure 3:
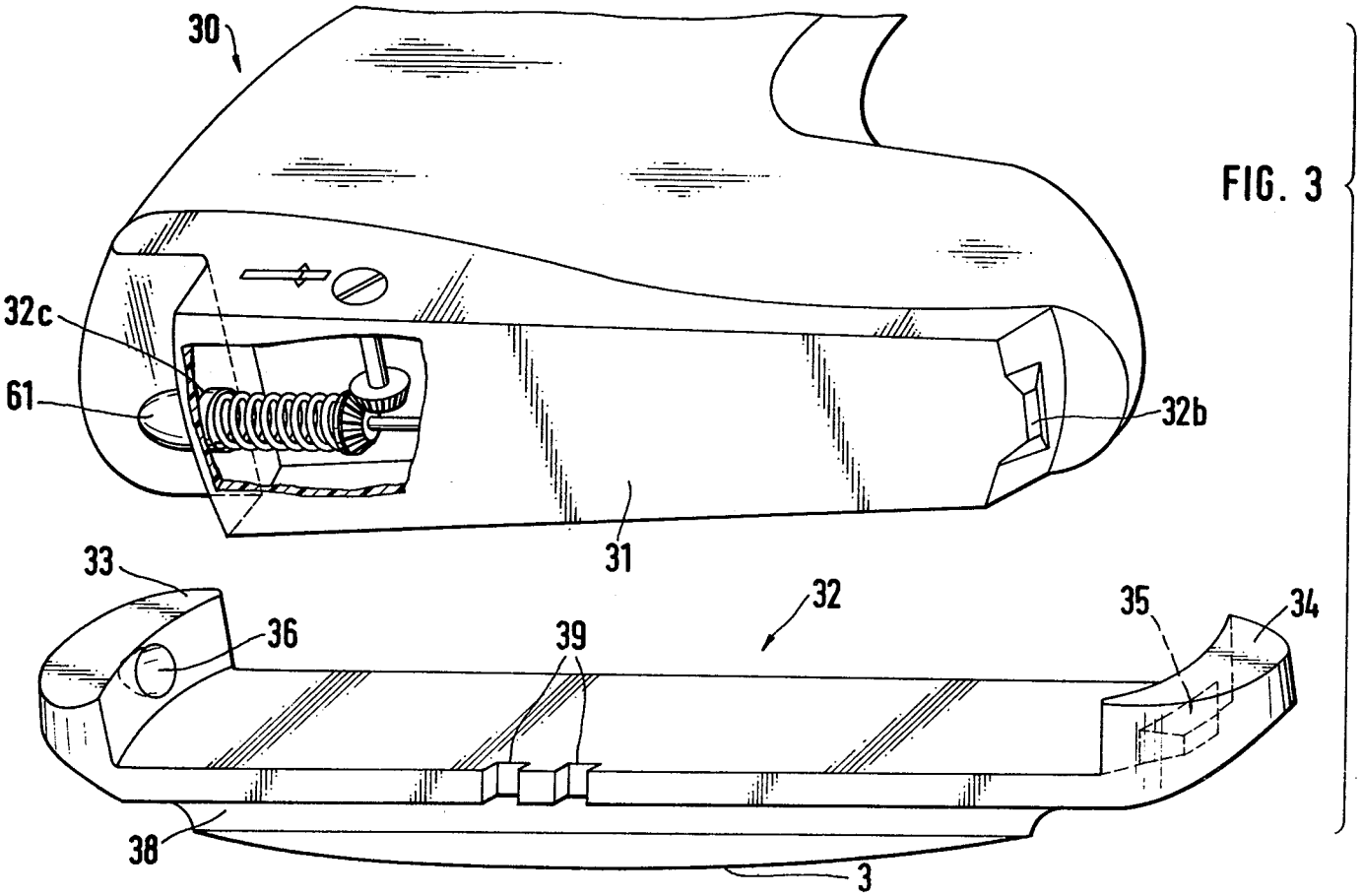
FIG. 3 is an exploded view of a ski-boot equipped with a rolling sole and with a safety binding incorporated into the sole.
Figure 4:
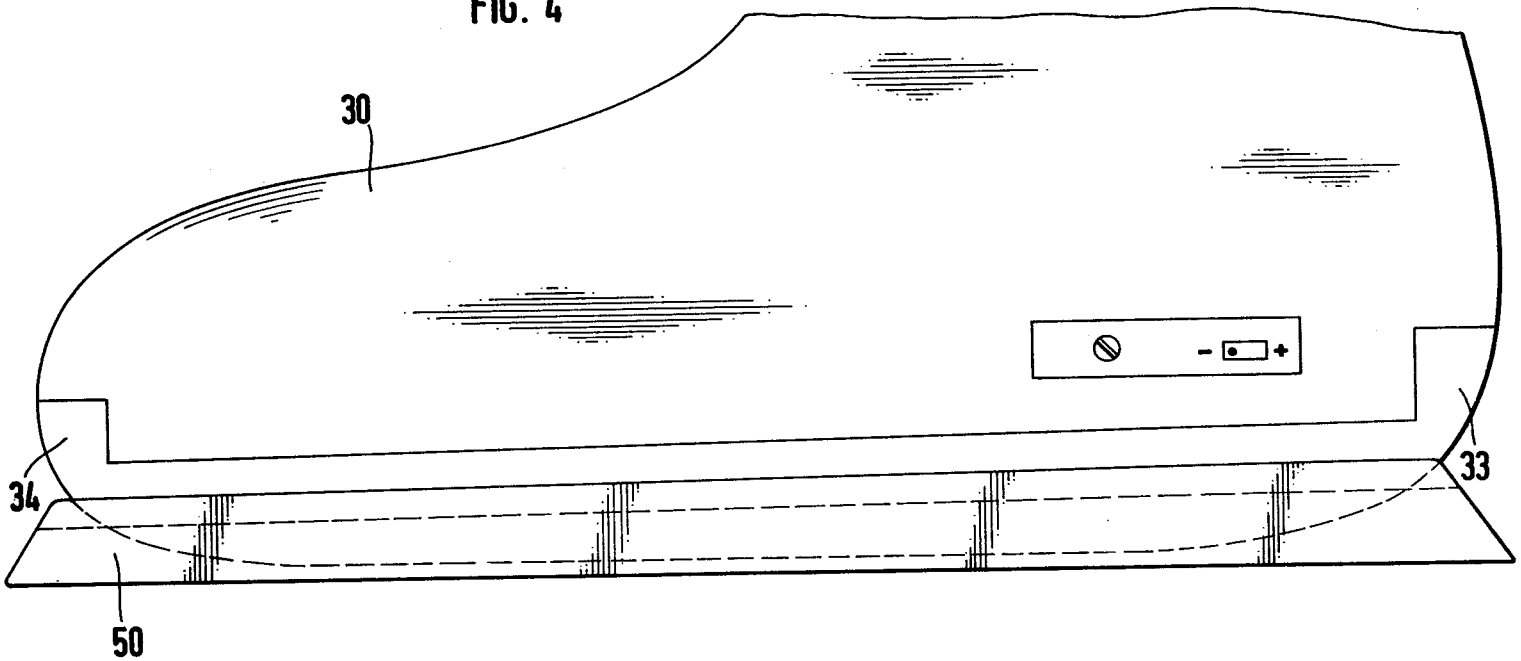
FIG. 4 is a side elevation of the ski-boot according to FIG. 3, secured to the ski-boot and ready for use.
Figure 5:
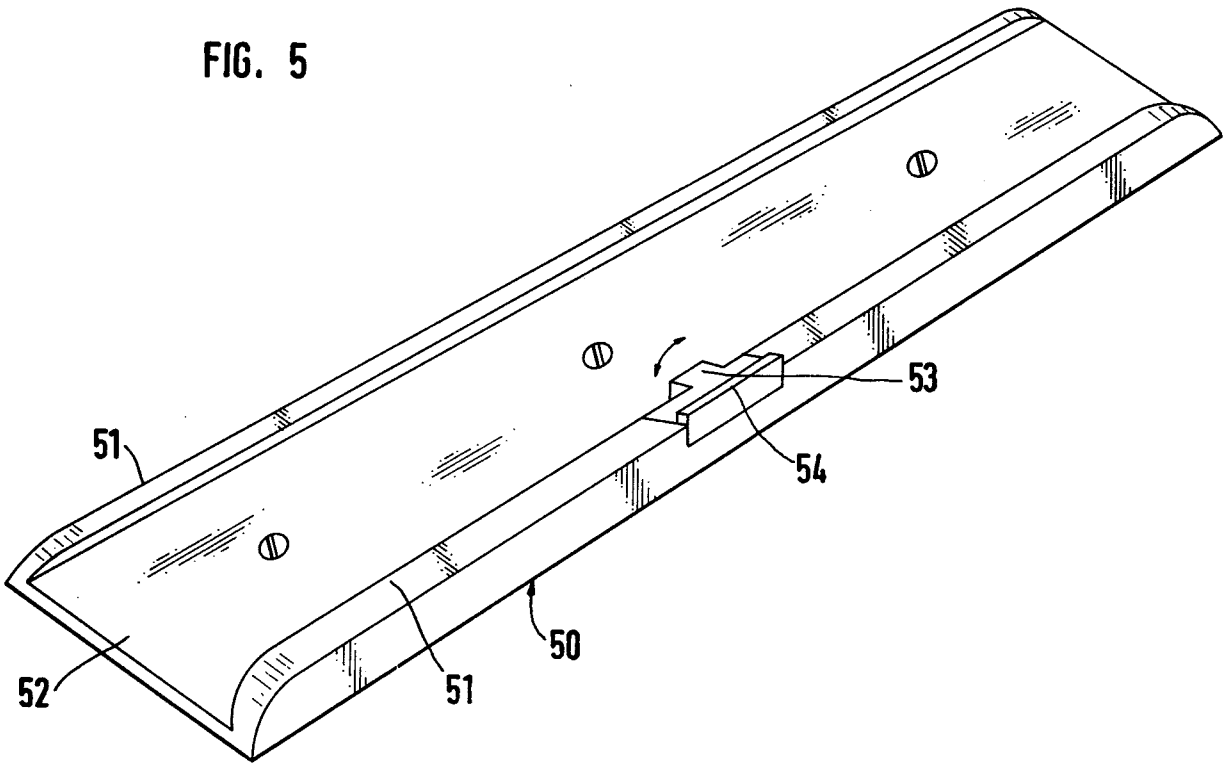
FIG. 5 is a perspective view of a profiled plate used as a binding for the ski-boot according to FIGS. 3 and 4.

FIGS. 1 and 2 show, purely diagrammatically, side elevations of a ski-boot having an upper 1 and a sole 2. Tread side 3 of the sole is curved uniformly in the longitudinal direction thereof, with a constant radius of curvature. In the design according to FIG. 2, the sole has a somewhat flatter curvature in the middle, i.e. the radius of curvature in the middle is larger than at the two ends.

In the examples illustrated in these two figures, the ski-boot is arranged upon a ski, not shown in detail, to which it is secured, at toe and heel, by ski-binding parts 6 which have projections 7 extending under sole 2 of the ski-boot, the said projections being shaped to match the curvature of the outer sole and thus providing effective support for the said sole when the ski is in use. Ski-binding parts 6 are rigidly connected to the ski. In the example of embodiment according to FIG. 1, release of the ski-boot in the event of a dangerous fall is effected by means of a safety binding 4 which is incorporated into sole 2 and is shown in detail in FIG. 6. In the example of embodiment according to FIG. 2, ski-binding part 6, associated with the heel of the ski-boot, is provided with a spring-loaded compression pin 5 adapted to engage in a corresponding recess in the heel of sole 2. This pin, which has a rounded head, may be released manually by means of a mechanism not shown in detail.

Figure 6:
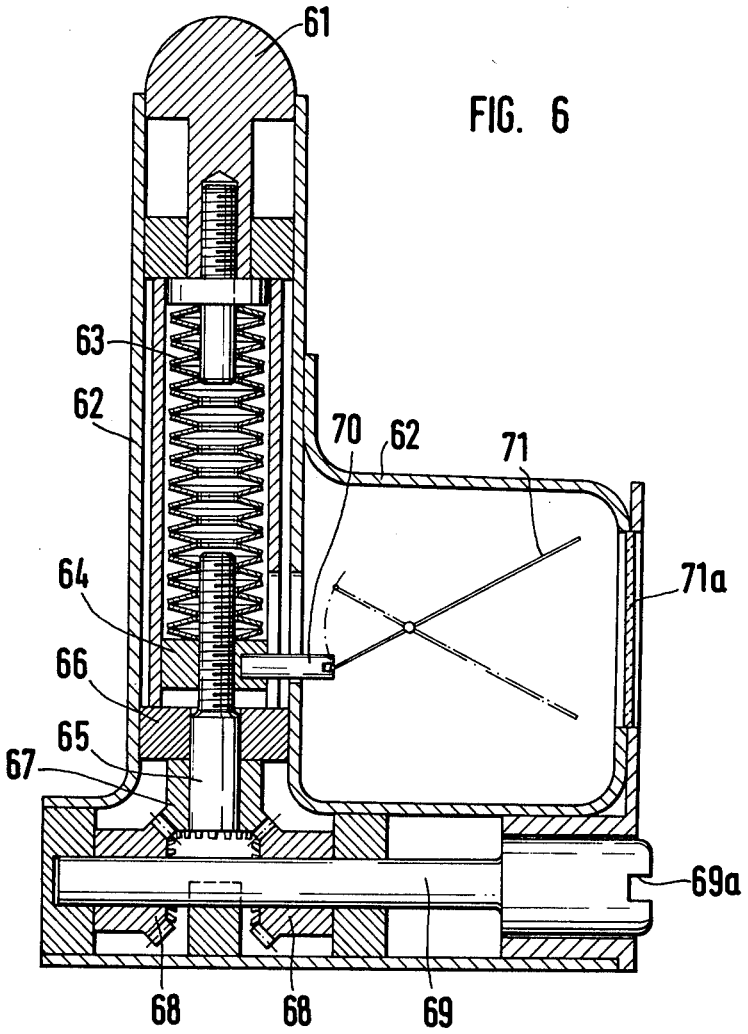
FIG. 6 is a detail of the safety ski-binding incorporated into the sole, preferably for use with the ski-boot according to FIGS. 1 and 3.

FIGS. 3 to 6 illustrate a design of ski-boot having a rolling sole and a matching ski-binding. The ski-boot, marked 30 as a whole comprises a sole consisting of a sole core 31 and a tread part marked 32 as a whole, the safety binding (FIG. 6), the tension of which is adjustable from the outside, being incorporated into the said sole core. The front end of the said core has a nose 32*b*, while the rear end has an aperture 32*c* from which pin 61 of the safety binding projects (FIG. 6). Nose 32*b* may also be resiliently retractable and be mounted in a recess in sole core 31.

The front and rear ends of tread part 32 each have a protuberance 33, 34 comprising cavities 36, 35 matching compression pin 61 and nose 32*b* of the safety binding. The lower surface of tread part 32 is curved in the longitudinal direction of the sole to form the rolling sole already described in conjunction with FIGS. 1 and 2. Each longitudinal side of tread has a longitudinal groove which is open at both ends, is approximately triangular in cross section, and is adapted to be inserted into a dovetailed guide in a profiled plate (FIG. 5), as explained hereinafter.

When the ski is in use, tread part 32 is secured to sole core 31 by the ski-binding incorporated into the sole. In addition to this, a profiled plate, marked 50 as a whole, is secured to the ski, not shown, in the longitudinal direction thereof (FIG. 5), the said plate having upstanding lateral edges 51 constituting a wide dovetailed groove 52, the said width corresponding to that of tread part 32 and, more particularly, to the distance between longitudinal grooves 38 therein. In order to use the ski, the ski-boot is secured thereto by sliding grooves 38 into dovetailed groove 52 in profiled plate 50, in which position the boot is locked by means of a spring-loaded pawl 53 having a gripping edge 54, the said pawl being mounted in one of the edges so that it may pivot about an axis parallel with edges 51, and may thus engage in a lateral recess in tread part 32. Dovetailed groove 52 may be replaced by push-in grooves, at right angles to the surface of the ski, in profiled plate 50, in which case ski-boot 30 is held by means of pins, not shown, seated in aligned holes in edges 51 and tread part 32.

In the event of a fall, ski-boot 30, with sole core 31, leaves tread part 32, the latter remaining in profiled plate 50. All that the skier need do in order to continue skiing is to step, with sole core 31, on tread part 32, thus allowing pressure pin 61 and nose 32*b* to engage once more in recesses 36, 35 in tread part 32. At the end of the run, the skier releases pawl 53 from recess 39, and removes his foot, with the ski-boot, from profiled plate 50. He can then walk without any difficulty.

It is to be understood that the height of dovetailed groove 52 in profiled plate 50 is such that tread part 32 can be inserted into the said groove and, in addition to this, can rest upon the bottom of the said groove. However, this is not essential, since edges 51 of profiled plate 50, co-operating with longitudinal grooves 38, provide adequate support.

FIG. 6 is a plan view of the safety binding incorporated into sole core 31 of the ski-boot 30. This safety binding is contained in a cassette 62 and comprises a pressure pin 61 axially displaceable in a tubular part of the said cassette. Pressure is applied to pin 61 by means of plate springs 53 bearing at one end against the said pin and, at the other end, against an adjusting nut 64. This nut co-operates with an adjusting screw 65 which is mounted rotatably in a bearing ring 66 and carries a bevel gear 67 on its free end. Engaging with bevel gear 67 are two other bevel gears 68 secured to a shaft 69, one end of which projects from cassette 62 and is provided with a slot **69*a* for the purpose of adjusting the said nut 64. The latter is provided with a dog 70 which moves therewith in an elongated hole, actuating a pointer 71 which indicates the pre-tension applied to pressure pin 61 and thus the retaining force of the safety binding. The position of pointer 71 may be read-off from the outside through a window 71*a***.

FIG. 7 shows the heel retainer in a so-called step-in binding. This retainer may be from any known design of ski-binding. Characteristic of the said retainer is an actuating plate 73 adapted to be pivoted in a downward direction, together with the retaining elements of the heel retainer, by the application of a downward pressure. In the case of a conventional ski-boot having a flat sole, the skier depresses this actuating plate with the heel of his boot. As soon as a certain position is reached, retaining elements 72 snap over the edge of the sole in the vicinity of the heel of the boot, where they are locked by the mechanism of the ski-binding. According to the invention, a moulded part 75 is associated with the heel retainer and is secured to the ski in front of the heel retainer. This component is in two parts, a stationary part 75' secured to the ski, not shown, and a part 75'' hinged thereto by means of a bearing extension 76 which pivots about an axis, not shown, running parallel with the surface of the ski. Bearing extension 76 engages in a matching slot in stationary part 75'.

Hinged part 75'' has a rearwardly extending spur 78, the path of travel of which intersects with the path of travel of actuating plate 73, thus making it possible for the said spur to apply pressure to the said plate.

The upper surface of hinged part 75'', including spur 78, is curved to match the curvature of tread part 3 of the ski-boot. The under surface of the said hinged part is flat and runs, when the heel retainer is in the locked position, roughly parallel with the upper surface of the ski. In the locked position it ensures that the ski-boot is securely mounted on and supported by the ski. The method of operation of hinged part 75'', when the skier steps into the ski-binding, is apparent from FIG. 8 without further explanation.

FIG. 9 shows another design of moulded part 75 according to FIGS. 7 and 8. In this case, stationary part 75' of the moulded part has a rearwardly extending projection 90 upon which hinged part 75'' is mounted on an axis 91 running parallel with the surface of the ski. This axis may be in the form of a pin passing through projection 90 and accommodated in bearing holes in hinged part 75''. Axis 91 carries, on each side of projection 90, a thigh-spring 92, one end of which bears against hinged part 75'', while the other end bears against stationary part 75'. Thigh-springs 92 are preloaded, so that when no load is being applied to hinged part 75'', they cause this part to pivot in an upward direction.

Located in the lateral surfaces of hinged part 75'' facing the longitudinal edges of the ski are threaded holes 94 which are used to secure the catcher spurs 95 of a so-called ski-stopper, as shown in the exploded view in FIG. 9. The catcher spurs are offset in order to ensure that they can pivot freely without coming into contact with the lateral surfaces of the ski. They are also provided with holes 96 through which the attachment screws may be passed.

If the skier, upon stepping into the ski-binding, steps upon moulded part 75, hinged part 75'' will be pressed downwardly against the action of thigh-springs 92. This causes the — not shown — actuating plate of the heel retainer to move to the closed position, thus locking the said retainer. This also pivots catcher spurs 95 into an inactive position parallel with the longitudinal sides of the ski. Now if the ski-binding is released during a run, for example as a result of a fall, and if the ski-boot leaves the ski, thigh-springs 92 cause hinged part 75'' to pivot upwardly, thus at the same time pivoting catcher spurs 95 into the operative braking position. As soon as the ski is released, these spurs act in known fashion as brakes, by digging into the snow and halting the ski. Hinged part 75'' acts as a ski-stopper regardless of which part of the ski-binding is responsible for the release. In other words, hinged part 75'' is also pivoted upwardly even if the holding elements of the heel retainer remain closed. It is to be understood that the path of travel of the holding elements, on the one hand, and that of hinged part 75'', on the other hand, is designed to ensure that there is no interference between the two components.

The drawing also shows attachment holes 98 in stationary part 75', by means of which moulded part 75 is screwed to the ski. It is also possible for moulded part 75 to be secured to a base plate common to both the heel retainer and the said moulded part. Thus, when the ski-binding is adjusted to the size of the ski-boot, moulded part 75 moves automatically with the heel retainer.

The provision of threaded holes 94 makes it possible to attach catcher spurs 95 to hinged part 75'' at will. Thus the skier may decide whether to use a ski-stopper or not.

FIGS. **10*a*, 10*b* show diagrammatically the heel-retaining part of a so-called step-in binding having an approximately horseshoe-shaped holding element 101 which, in the closed position, engages over an edge provided on the heel of the boot and thus retains the said boot (cf. FIGS. 7,8). The heel-retaining part shown in the open position in FIG. 10*a* is adapted to be depressed by actuating spurs 102. When stepping into the ski-binding, the skier places his heel upon actuating spurs 102, presses them downwardly, and thus moves holding element 101** over the aforesaid edge on the ski-boot.

Actuating spurs 102 are themselves designed as moulded parts and they serve to compensate for the difference in height between tread side 3 of sole 2 of the ski-boot and the surface of the ski. To this end, they increase in height or thickness towards the rear in the form of wedges, as may be seen in FIG. **10*a***, the upper surfaces of the said wedges having a slightly concave curvature.

In the example of embodiment illustrated, actuating spurs 102 are shown as moulded parts connected to the heel-retaining part. It is also possible, however, to provide the heel-retaining part with an actuating spur, or an actuating plate, of conventional design, but having screw holes and possibly guides for the attachment of moulded parts delivered as accessories. In this case, the heel-retaining part as a whole again has the configuration shown in FIG. **10*a***. The said moulded parts may be provided with slots or insert holes, so that they may easily be slipped onto a conventional actuating spur or plate, and then be secured thereto.

Figure 10B:
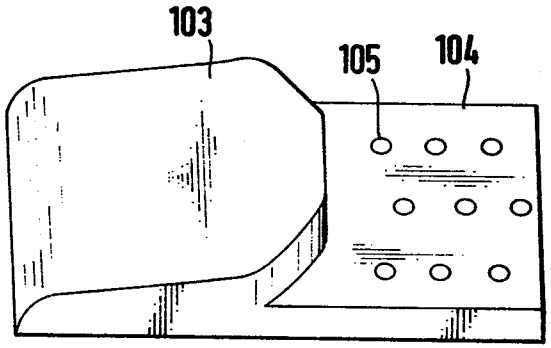
FIGS. 10*a*, 10*b* are perspective views of the heel retaining part of a so-called step-in binding, in which the depressible actuating spur is a moulded part.
Figure 10A:
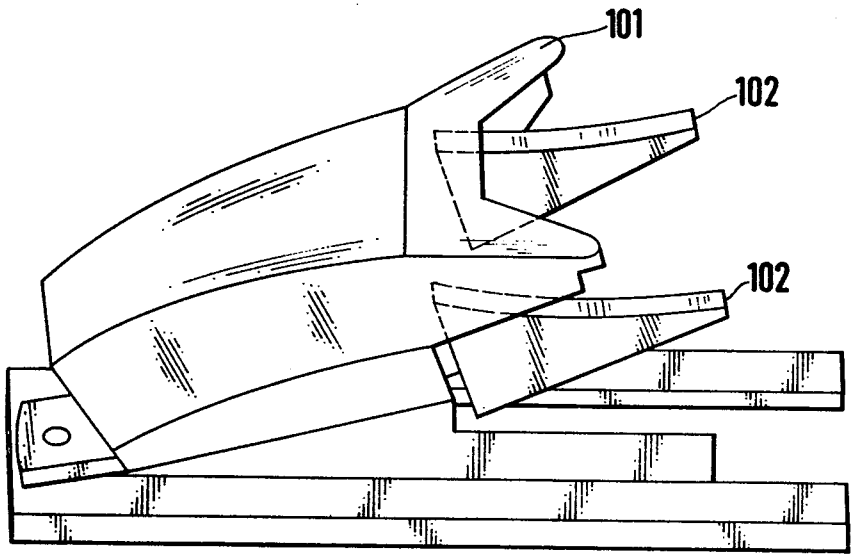

FIG. 10*b* shows front moulded part 103 which is associated with the front retaining part, not shown, of the binding. Moulded part 103 is made in one piece with a packing plate 104 comprising attachment holes 105, the said component being made of a synthetic material. These holes are used to attach moulded part 103 and the front retaining part, thus making it possible to maintain at all times the correct distance between moulded part 103 and the said retaining part. If required, the number of holes 105 provided may correspond to the holes in different brands of ski-bindings, being suitably marked to enable them to be used for each type of binding.

FIG. 11*a* shows a moulded part marked 115 as a whole which is associated with the heel-retaining part, not shown, comprising a rotary plate. The said heel-retaining part is secured to rotary plate 110, which is illustrated purely diagrammatically, and which comprises, for example, a pivotable part spring-loaded to snap in behind a projection upon the heel of the ski-boot, the said pivotable part being hinged to rotary plate 110 by means of a linkage engaging from behind with both sides of the ski-boot. Heel retainers for rotary plate ski-bindings of this kind are well known and need not therefore be described here in detail.

In the example of embodiment illustrated, moulded part 115 consists of a stationary part 115' and a pivoting element 115" hinged thereto by means of an axis, not shown, running parallel with the surface of the ski and passing through a rearwardly extending projection 112 of stationary part 115'. Adapted to be screwed from behind into pivoting element 115" is a locking screw 129 which engages in a bore in projection 112, thus locking the said pivoting element in the down position. Thus, moulded part 115 may, if required, be converted into a rigid moulded part, which is useful if pivoting element 115" renders the actuation of a ski binding part unnecessary.

The mounting of rotary plate 110 and relevant stationary part 115' is shown in FIG. 11*b*. In this figure, the ski, shown in cross section, is marked 131 and carries a stationary slide plate 132 upon which the rotary plate is mounted to pivot about a vertical axis 133, the said rotary plate being secured by means of a disc 134. Seated upon disc 134 is a plate 135 comprising a bearing pin 136 which may also be seen in perspective in FIG. 11*a*. Plate 135, disc 134 and slide plate 132 are secured to the ski by means of screws, not shown, inserted into holes 137 in plate 135. The turned-up edge of disc 134 engages over a step in rotary plate 110, thus constituting a radial guide locating the rotary plate upon the ski.

A bearing hole 138 in stationary part 115' of moulded part 115 is placed upon bearing pin 136 and is pressed, by means of a screw 139, not shown in FIG. 11*b*, to the upper surface of rotary plate 110, so that it rotates as a unit therewith. Screw 139 is screwed into a threaded hole 140 in bearing pin 136, the underside of the head of the said screw being made smooth to act as a thrust bearing, thus allowing stationary part 115' to rotate in relation to the screw, this ability to rotate being improved, if necessary, by the addition of washers or the like. It is to be understood that there are other ways of connecting stationary part 115' to bearing pin 136. For example, the upper end of the said bearing pin may have a threaded extension adapted to accommodate a flat nut countersunk into a recess in bore 138.

Plate 135 and bearing pin 136 may be of such a size, and may have holes 137 arranged in such a manner, that it fits known rotary plate bindings, especially disc 134 thereof. This makes it possible to secure plate 135 with the same screws used to attach rotary plate 110 to the relevant ski-binding. Thus moulded part 115, together with plate 135 and screw 139, may be designed as an accessory for known rotary plate ski-bindings.

It is to be understood that stationary part 115' may be adapted to the shape of rotary plate 110, especially if the said plate is circular, to ensure that when it is rotated, no part thereof projects beyond the lateral defining surfaces of the ski.

A bearing hole 138' is provided, in addition to bearing hole 138, in order to make it possible to mount moulded part 115 in the correct location at all times in accordance with the different distances between the centre of rotation of the rotary plate and the heel-retaining part in ski-bindings made by various firms. For instance, rotary plate step-in bindings in which use is made of the ability of pivoting element 115" to pivot usually require a greater distance than simple rotary plate bindings between the centre of rotation and the rear edge of said pivoting element since, in the latter type of binding, the heel-retaining part is actuated by hand and pivoting element 115" is not used.

FIG. 12*a* shows a rotary plate 208 already in the form of a moulded part, which makes the use of a matching moulded part 115, as in FIG. 11*a*, unnecessary. Rotary plate 208 is secured to the ski by means of a disc 210 secured to the ski by screws 209, and edge thereof — not visible in FIG. 12*a* — engaging over a corresponding shoulder on rotary plate 208. The mounting of rotary plate 208 thus corresponds to that of rotary plate 110 in FIGS. 11*a* and 11*b*, with disc 210 corresponding to disc 134 in FIG. 11*b*.

Rotary plate 208 has lateral lugs 211 to which is hinged a linkage 212 for the heel-retainer, shown only diagrammatically, of the ski-binding.

As may be gathered from FIG. 12*a*, the thickness or height of rotary plate 208 increases towards the rear (to the left in the drawing) in the form of a wedge and, here again, the upper surface has a slightly concave curvature. It is to be understood that disc 210, and screws 209, are countersunk into a corresponding recess in rotary plate 208, so that the ski-boot rests upon rotary plate 208 and not upon disc 210.

FIG. 12*b* shows front moulded part 203 with packing plate 204, the said part being used in this form in conjunction with the front jaws of the rotary plate binding.

FIG. 13 shows a modification of the rotary plate according to FIG. 12*a*, namely a rotary plate 208' designed for a rotary plate step-in binding. Rotary plate step-in bindings are known to have a heel-retainer actuated by stepping upon it with the heel of the ski-boot, so that it is pivoted into the holding position. In order to be able to actuate the heel-retainer in this way, rotary plate 208', the thickness of which also increases towards the rear, has a pivoting element 215 in the form of a plate hinged to the said rotary plate by means of hinges 216. In the depressed position, this plate fits into a recess 217 in the said rotary plate in such a manner that it lies flush with the surface thereof which slopes upwardly towards the rear and has a slightly concave curvature. The said pivoting plate also has an extension 218 extending below the rear outer side of rotary plate 208', the path of pivoting of the said plate lying in the path of travel of the heel retainer which is illustrated only diagrammatically. Thus when pivoting element 215 is stepped upon, the heel retainer is moved into its closed position.

FIG. 14 shows a base plate, marked 220 as a whole, in a known plate binding. The ends of this base plate co-operate with the ski-releasing mechanism in such a manner that, in the event of an overload, i.e. if the skier falls, the said base plate is released from the ski. The front of base plate 220 may have a device of this kind in the form of a bore, not shown, in engagement with a spring-loaded pressure pin — also not shown — on the ski, whereas the rear end of the said base plate is provided with a sloping surface 228 which co-operates with a release element — also not shown — on the ski. Plate bindings of this kind are known, and there is therefore no need to explain in detail the type of co-operation between base plate 220 and the release mechanism secured to the ski.

For the purpose of holding the ski-boot, the base plate is fitted with a front attachment 221 engaging over the edge of the sole at the toe of the boot, and with a heel retainer 222 engaging behind an edge on the heel of the ski-boot and secured pivotably to the said base plate by means of a linkage 123. As shown in FIG. 14, the undersurface of base plate 220 is flat and therefore rests uniformly upon the surface of the ski, whereas the upper surface has a concave curvature corresponding substantially with the curvature of tread part 3 of outer sole 2 (see FIGS. 1 and 2) of the ski-boot, not shown in FIG. 14. Since the position of the ski-boot in relation to front attachment 221 always remains the same regardless of the size of the ski-boot, the thickness or height of the front end of base plate 220 is such as to produce a concave shape. In the vicinity of the heel, however, there is a moulded part 225 which is separate from the base plate and which is adapted to move in the longitudinal direction of the base plate in a guide groove, not shown. Moulded part 225 is located by means of pins projecting inwardly from linkage 223 inserted into opposing holes in a series of holes 224. Thus moulded part 225 and heel retainer 222 are both located by the same means of attachment, namely linkage 223. If heel retainer 222 is adjusted, moulded part 225 may also be adjusted therewith.

What I claim as new and desire to protect by letters Patent of the United States is:

1. A ski-boot having an upper and a sole, said sole comprising a sole core and an outer sole part connected detachably to said sole core, said sole being in the form of a rolling sole and having a tread side curved continuously in the longitudinal direction of said sole over the entire length thereof.

2. A ski-boot according to claim 1, wherein said tread side is curved continuously with a constant radius of curvature.

3. A ski-boot according to claim 1, comprising a safety binding having parts incorporated into said sole core and outer sole part and attaching said outer sole part to said sole core.

4. A ski-boot according to claim 3, wherein said safety ski-binding comprises at least one spring-loaded, rounded-off pressure pin adapted to be inserted into a recess in the outer sole part; and an adjusting device for adjusting the spring-loading of said pressure pin.

5. A ski-boot according to claim 3, wherein said outer sole part has a protuberance at the front and rear end, said protuberance containing recesses for the positive engagement of said parts of the safety ski-binding provided in the sole core.

6. The combination of claim 3, wherein a longitudinal groove, open at least at one end, is provided in each of the lateral sides of said outer sole part, by means of which said outer sole part may be slid onto upstanding edges of a profiled plate on a ski.

7. The combination according to claim 6, with a ski having a profiled plate and a closure adapted to lock said outer sole part to said profiled plate of said ski, in the longitudinal direction thereof.

* * * * *